United States Patent [19]

Tannery

[11] 4,312,527

[45] Jan. 26, 1982

[54] COMPACT AMBIDEXTROUS LOCKING MECHANISM

[75] Inventor: Edward F. Tannery, Coldwater, Mich.

[73] Assignee: Theodore Bargman Company, Coldwater, Mich.

[21] Appl. No.: 133,913

[22] Filed: Mar. 25, 1980

[51] Int. Cl.[3] ..... E05C 3/06

[52] U.S. Cl. ..... 292/49; 292/197; 292/340

[58] Field of Search ..... 292/40, 46, 49, 197, 292/215, 224, 340; 70/121, 122, 123, 136

[56] References Cited

U.S. PATENT DOCUMENTS

| | | | |
|---|---|---|---|
| 1,264,814 | 4/1918 | Kornstein | 70/136 |
| 1,410,581 | 3/1922 | Langer | 292/49 |
| 1,512,141 | 10/1924 | Segal | 292/49 |
| 1,662,907 | 3/1928 | Shilling | 292/49 |
| 2,118,729 | 5/1938 | Hogan | 292/49 |

*Primary Examiner*—Robert L. Wolfe

*Attorney, Agent, or Firm*—McCaleb, Lucas & Brugman

[57] ABSTRACT

Locking mechanism having a casing including a pair of spaced support plates of similar or identical size and shape. The support plates have identical, spaced, congruent, T-shaped tongues along their front edges. When the locking mechanism is installed in a door, the tongues extend beyond the front edge to engage a C-shaped strike in the door jamb. A pair of flat-bodied, blade-like bolt members, having shank and latch portions at opposite ends, and pivoted therebetween, are located side by side in coplanar relation in a space between the support plates. The latch portions project outwardly beyond the front edge of the door, between the T-shaped tongues. A flat, eccentric, plate-like cam member is rotatably supported between the shank portions of the bolt members. The cam and bolt members are constrained to a mutually coplanar relation by a sliding contact with the inner surfaces of the support plates on both sides. Manual operation of the cam member by a hand knob or lever moves the latch portions of the bolt between open and closed positions within recesses formed by the T-shaped tongues. In the closed position, they are expanded to engage sawteeth in the strike. In the open position, they are contracted to disengage the strike. When the door is closed, the stems of the T-shaped tongues are swung through an open passageway in one side of the strike, and the heads engage the undersides of the strike making accidental disengagement virtually impossible. Two embodiments are described, one with a rotary cam, and another with a reciprocal cam.

5 Claims, 14 Drawing Figures

Fig. 1.
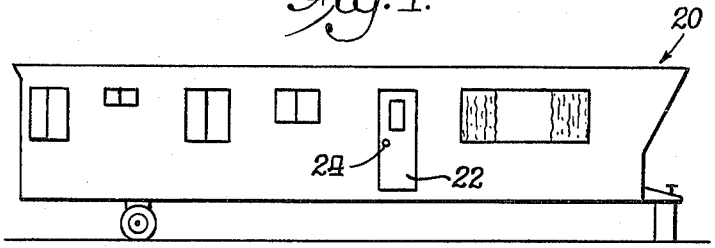
Fig. 2.
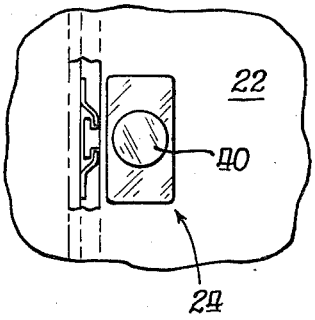
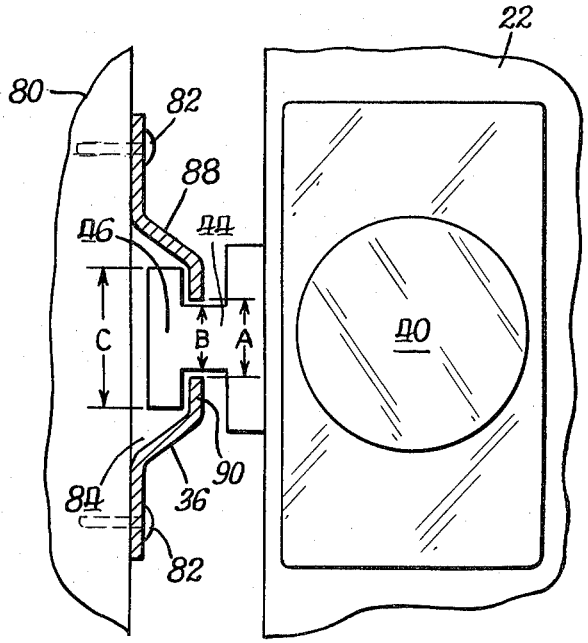
Fig. 4.
Fig. 3.
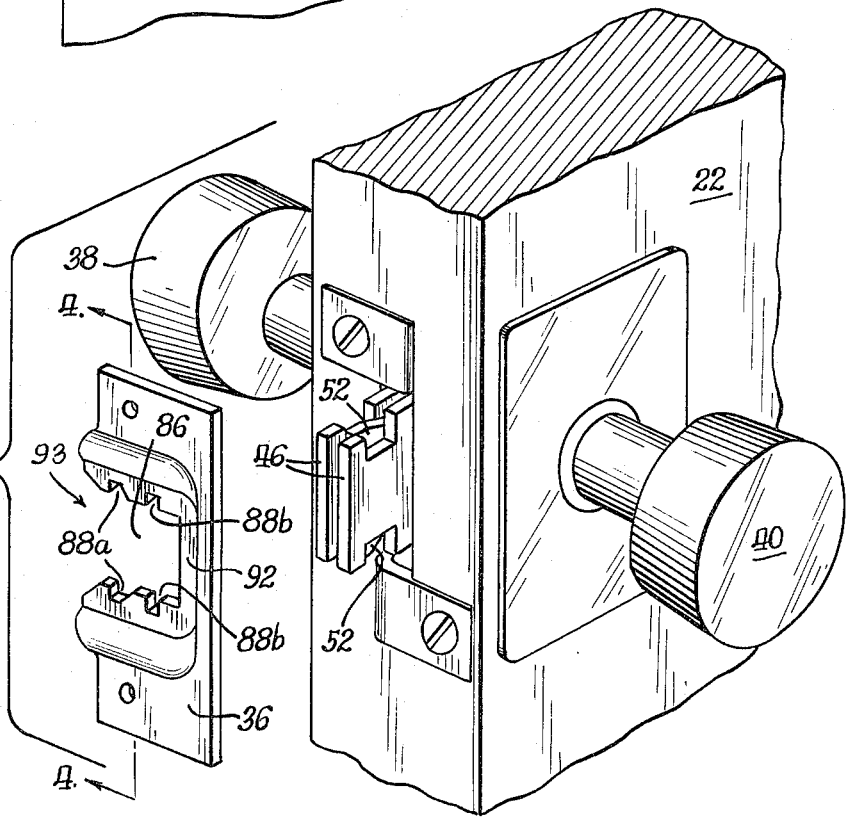

COMPACT AMBIDEXTROUS LOCKING MECHANISM

BACKGROUND OF THE INVENTION

This invention belongs to the field of locking mechanisms, particularly the kind used for recreational vehicles which must be extremely compact and secure to hold a closure such as a door or hatch closed even while the vehicle is in motion.

In recreational vehicles such as motor homes, travel trailers, campers, sports cars, and the like, there are very special requirements for doors, hatches, and trunk lids. Walls and doors are thin, making it impractical to use locks and latches designed for relatively thicker, stationary structures. Further, the possibility of death, injury, and property damage due to accidental opening while the vehicle is in motion requires positive locking security far beyond that required in a building structure. Yet, in spite of special safety requirements for conventional vehicle locking mechanisms, people continue to be killed or injured by falling out of moving vehicles when doors and hatches open accidentally.

SUMMARY OF THE INVENTION

It is a general object of the present invention to provide for a vehicle a locking mechanism which is thin and compact yet will hold a door, latch or lid securely closed while in motion despite vibration, and racking and warpage of the closure or frame.

A specific object is to provide a pair of scissor action, spring loaded bolt members with latches spring-urged in opposite directions into mating slots in a strike to positively hold the closure in locked condition despite severe racking or warpage.

Another object is to provide such a locking mechanism in which the casing has T-shaped tongues movable through an open side in a strike, the tongues having heads engagable behind the strike to prevent disengagement of the bolts from the strike even if the jamb is warped relative to the closure.

Another object is to provide an extremely thin but rugged and effective locking mechanism with a casing comprising two support plates fastened together in special relation, and having two flat, blade-like, coplanar bolt members pivoted in scissors fashion in the space between the support plates, and a flat, eccentric, plate-like cam member in that space engaging both bolt members, the bolt and cam members being coplanar and in slidable constrained relation with the inner surfaces of the casing support plates.

BRIEF DESCRIPTION OF THE DRAWINGS

Other objects and advantages will be apparent from the following description taken in connection with the accompanying drawings in which:

FIG. 1 is a side view of a recreational vehicle with a door illustrating one example where the cam operated locking mechanism of the present invention may be usefully employed;

FIG. 2 is a fragmentary enlarged view of FIG. 1;

FIG. 3 is a fragmentary enlarged perspective view of FIG. 2 illustrating how the locking mechanism fits within the front, swinging edge portion of a door;

FIG. 4 is a fragmentary cross-sectional view of FIG. 3 taken on line 4—4;

Like parts are referred to by like reference characters.

DETAILED DESCRIPTION OF PREFERRED EMBODIMENTS

Figure 5:
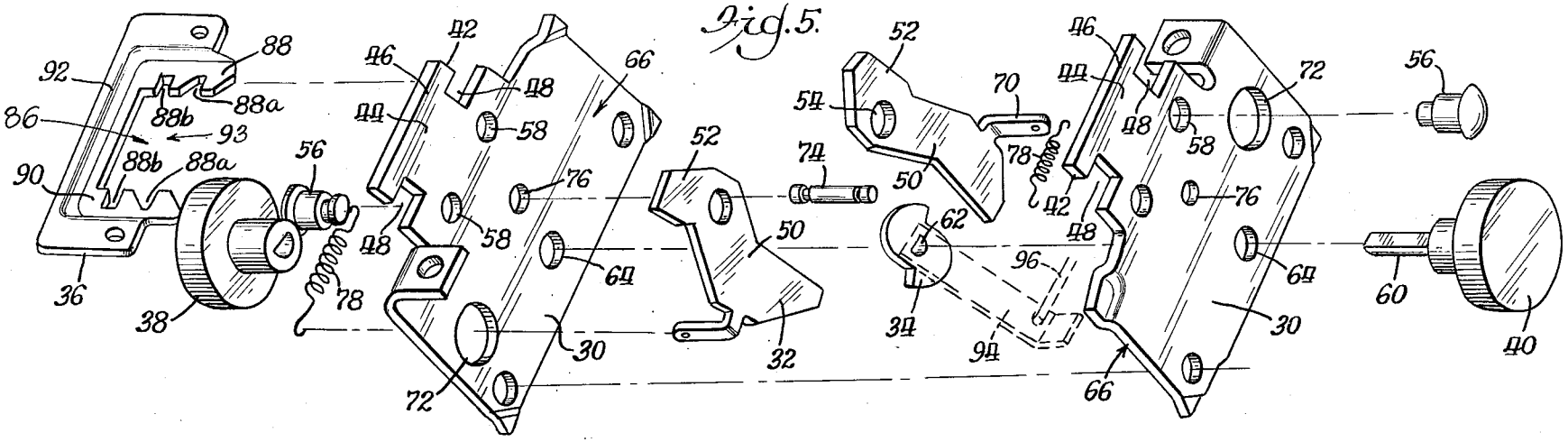
FIG. 5 is an exploded view of one form of the invention showing a rotary operating cam.
Figure 8:
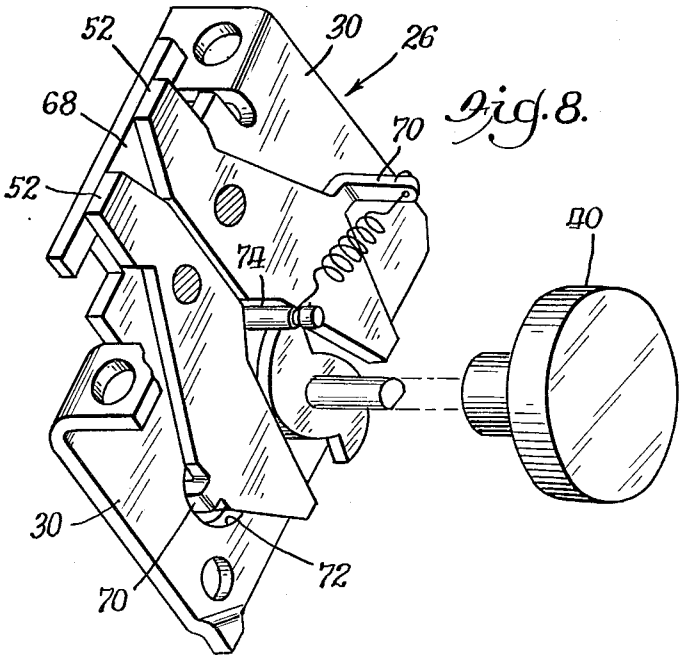
FIG. 8 is a view similar to FIG. 6 illustrated in open position.
Figure 6:
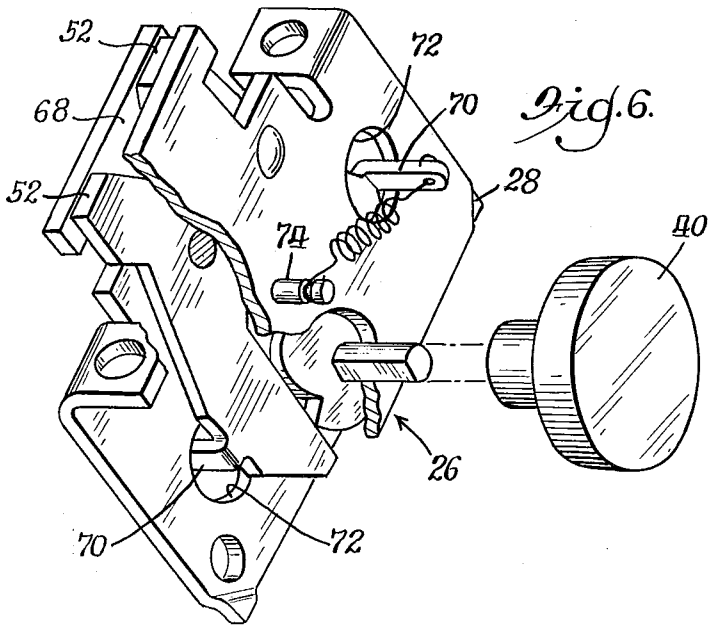
FIG. 6 is an assembly view of the parts shown in FIG. 5 illustrated in closed position.

Referring now more specifically to the invention shown in the drawings, a travel trailer or motor home 20 has a door 22 with a locking mechanism 24 which may be the embodiment designated 26 in FIGS. 3–9. Alternatively, the embodiment **26*a* shown in FIGS. 10–14** may be substituted.

Referring first to locking mechanism 26 in FIGS. 3–9, this has a casing 28 comprising a pair of identical support plates 30, 30, a pair of identical scissors-type bolt members 32, 32, a rotary cam member 34, a strike 36, and a pair of manually operable hand knobs 38, 40.

The support plates have identical, spaced, congruent, T-shaped tongues 42, 42 along front edges. Each tongue is positioned to extend outwardly beyond the swinging edge of the door, as best shown in FIG. 3. Each comprises a central stem 44 and a relatively wider head 46 at the extreme outer end, defining recesses 48, 48 under opposite ends of each head.

Each bolt member 32 has a relatively long shank portion 5 and a relatively short latch portion 52 on opposite sides of a hole 54 for a pivot pin 56 which is connected through opposed pairs of aligned holes 58, 58 in the two support plates.

The cam member 34 is a flat, eccentric, plate-like member. It is positioned intermediate the shank portions 50, 50 of the two bolt members and is rotatable by a flatted shaft 60 which is keyed through a flatted opening 62 in the center of the cam member. Hand knobs 38, 40 are fastened to the ends of the shaft 60 and are rotatably journaled through opposed openings 64, 64 in the two support plates.

The support plates are fastened together in a predetermined spaced relation, with mutually facing inner surfaces 66, 66 defining a space 68 (FIGS. 6 and 8) therebetween. This space is sufficient to enable the bolt and cam members to be freely slidable between the inner surfaces 66, 66 yet constrains them into coplanar alignment so rotation of the cam member by either of the hand knobs moves the bolt member latch portions 52, 52 between closed and opened positions shown respectively in FIGS. 6 and 8.

Each bolt member 32 has a transverse, offset arm 70 extending through an opening 72 in one of the support plates. An anchor pin 74 is fastened by a press fit through holes 76, 76 and extends outwardly on both sides to provide a common anchor for springs 78, 78 which are fastened to arms 70, 70. The springs urge the shank portions 50 of the bolt members into slidable, follower-type engagement with the eccentric peripheral edge of the cam member 34.

As best shown in FIGS. 3, 4 and 5, the strike 36 comprises a C-shaped plate attached to a jamb 80 by screws 82, 82. It has a concavity 84 (FIG. 4) and a pocket 86 (FIGS. 3 and 5) defined by upper and lower horizontal marginal walls 88 and 90 respectively, a back marginal wall 92, and an open passageway 93 opposite the back wall. As shown in FIG. 4, the width between upper and lower marginal walls 88 and 90 indicated by the dimension A, is greater than the width of the central stems 44 indicated by the dimension B. Thus, the passageway 93 is wide enough to enable movement of the central stems 44 through the passageway 93 into the pocket 86. Further, the width of the heads 46 indicated by dimension C is greater than the opening indicated by the dimension A. Thus, the heads 46 engage the undersides of the upper and lower walls 88, 90, making it impossible for the strike to disengage from the bolts even under severe warpage of the frame relative to the door.

The upper and lower walls 88, 90 of the strike have first and second pairs of saw-tooth notches **88*a*, 88*a* and 88*b*, 88*b*, respectively. In closing the door, spring-loaded latch portions 52, 52 first engage notches 88*a*, 88*a***. *When fully closed, they engage second notches 88b,* **88*b*. As an additional safety feature, the door will be held securely closed even if only one of the latch portions 52** engages a single notch.

Thus, by combination of the double heads 46, 46 engaging the undersides of the strike walls 88, 90, plus the double latch portions 52, 52 engaging the double notches **88*a*, 88*a*, or 88*b*, 88*b*, it is virtually impossible for the door to be opened inadvertently even under the most severe strain and warpage conditions that can be imposed on a vehicle in normal use, short of actual destruction. Yet the door may be opened easily by rotating either hand knob 38 or 40 to retract the latch portions 52, 52 to the open position shown in FIG. 8**.

One advantage of the present locking mechanism is the versatility by which it may be actuated. In addition to rotating the cam member 34 directly by hand knob 38 or 40, it can be remote operated either by a lever 94 connected by a rod 96 shown in broken lines in FIG. 5, or it may be operated by a solenoid (not shown) actuated from inside the vehicle. It may be directly operated by a key and key cylinder, by a lever with interior and exterior hand knobs, or a recessed handle. The mechanism is ambidextrous because no right or left hand parts are required for either side of a vehicle in which it is installed. The same basic mechanism may be applied to a front, back, right, or left door, or to a hatchback or trunk lid.

The alternate locking mechanism embodiment **26*a* shown in FIGS. 10–14 is similar to the one designated 26**, described above, however it has a reciprocably slidable cam member which will be advantageous in certain applications, for example where it is actuated by a linearly movable driver such as a solenoid armature.

Referring now more specifically to FIGS. 10–14, the alternate embodiment **26*a* has a casing 98 comprising a pair of support plates 100, 102. Unlike the previously described embodiment 26, which has identical support plates, those are not identical although they are similar in shape. Plate 100 may be considered a main plate, and plate 102 may be considered a cap or auxiliary plate fastened on last during assembly. Within the casing there is a pair of scissors-type bolt members 104, 106, a reciprocably slidable cam member 108, a rotary actuator 110, and a spring 118. Externally is a strike 36, and a pair of hand knobs 38, 40 which are identical in construction and function to those described in connection with locking mechanism 26**.

While support plates 100, 102 are different from those described in the previous embodiment, they have identical, spaced, congruent T-shaped tongues along their forward edges. These are, likewise, identical in construction and function to the tongues described in the previous embodiment and bear the same reference numerals.

The support plates may be stamped and formed from flat sheets or plates. Main support plate 100 has a pair of transverse tabs 112, 112 at its front edge, with screw holes 114, 114 for fastening to the swinging edge of a door, hatch closure, or the like. A third tab 116, at the rear edge of the support plate, functions as a seat for spring 118 as will be described. Opposed upper and lower edges of support plate 100 are inwardly upset to provide raised guide and spacing elements 120, 122 having inner guide edges 124, 126, respectively, to engage opposite edges 128, 130 of the cam member and guide it for straight line rectilinear movement, as will be described. The height of the elements 120, 122 determine the spacing between the support plates in the final assembly and is selected to provide a constrained, sliding fit for the bolt members 104, 106 and cam member 108 in the space 132 between the inner facing surfaces 134, 136.

Figure 10:
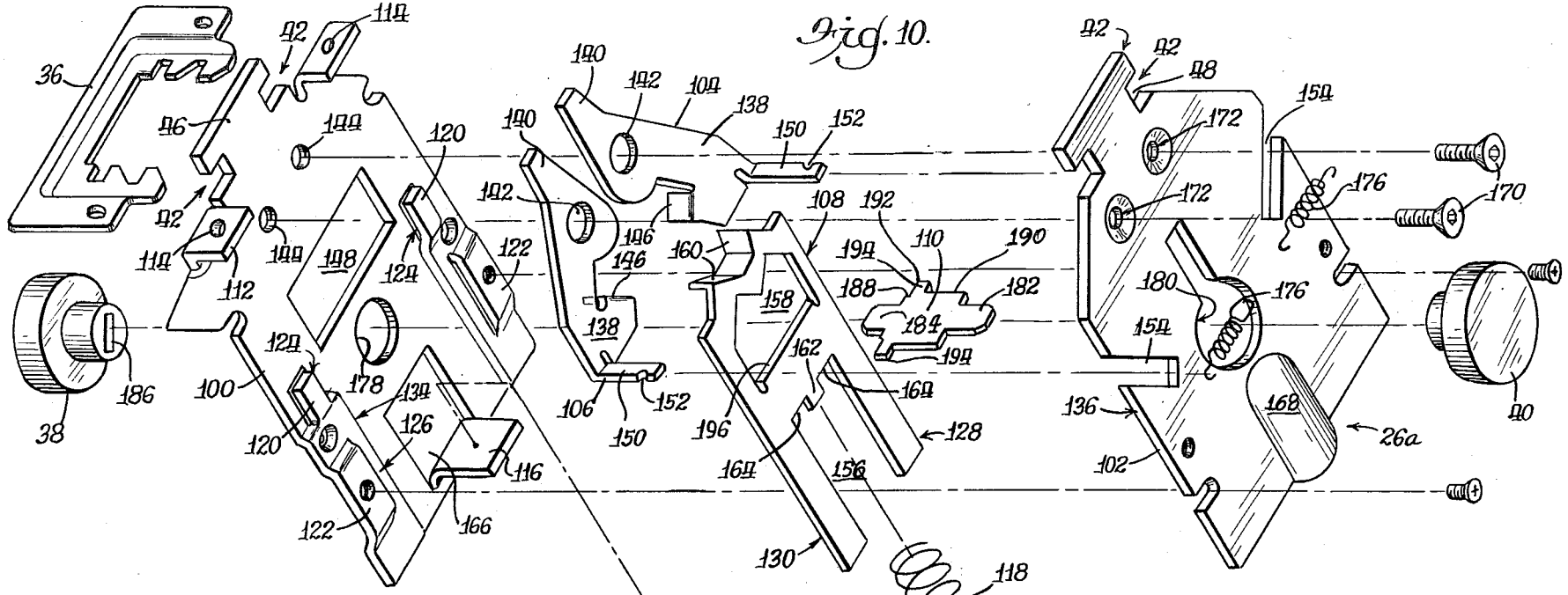
FIG. 10 is a view similar to FIG. 5 showing an alternate construction utilizing a slidable operating cam.
Figure 9:
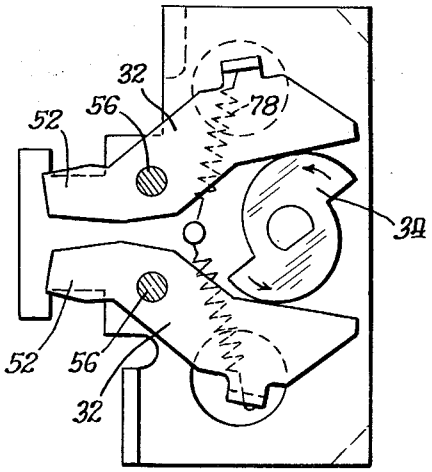
FIG. 9 is a view similar to FIG. 7 in open position.
Figure 7:
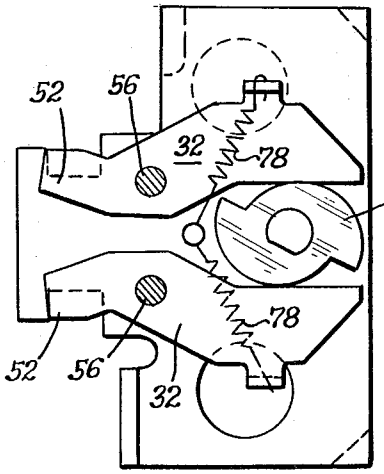
FIG. 7 is an internal view of FIG. 6.
Figure 11:
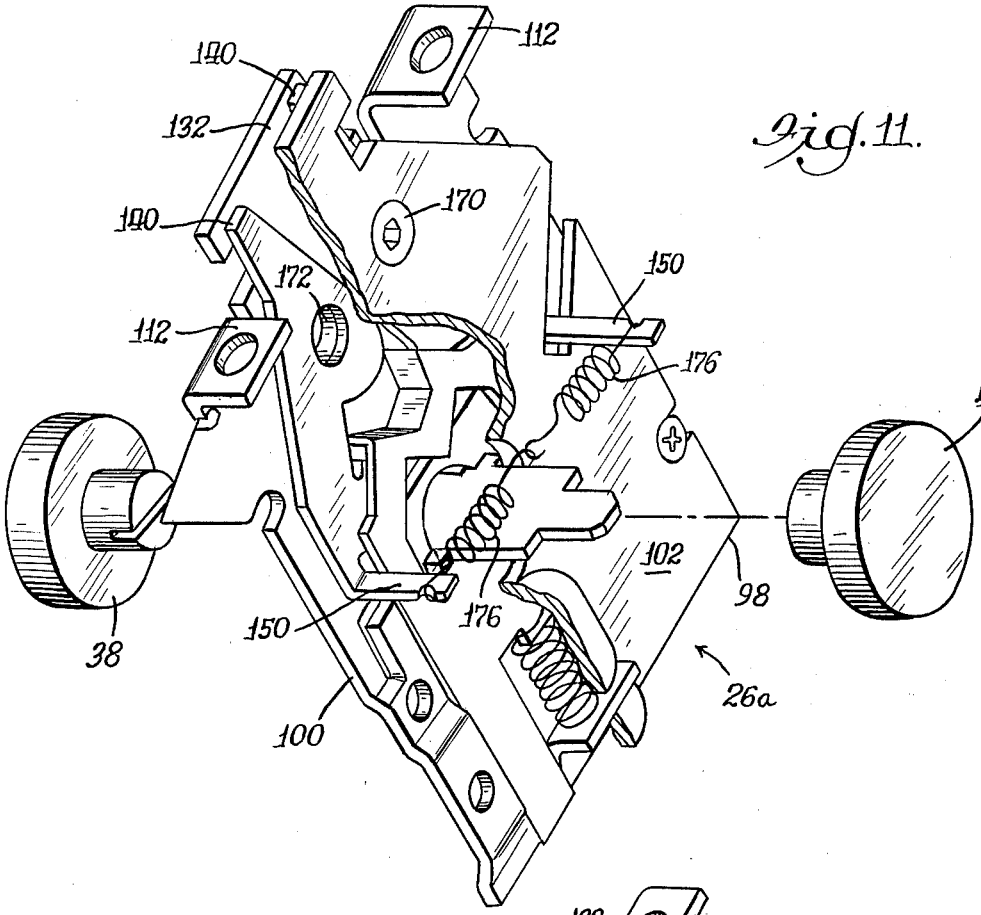
FIG. 11 is an assembly view of FIG. 10 illustrated in closed position.
Figure 12:
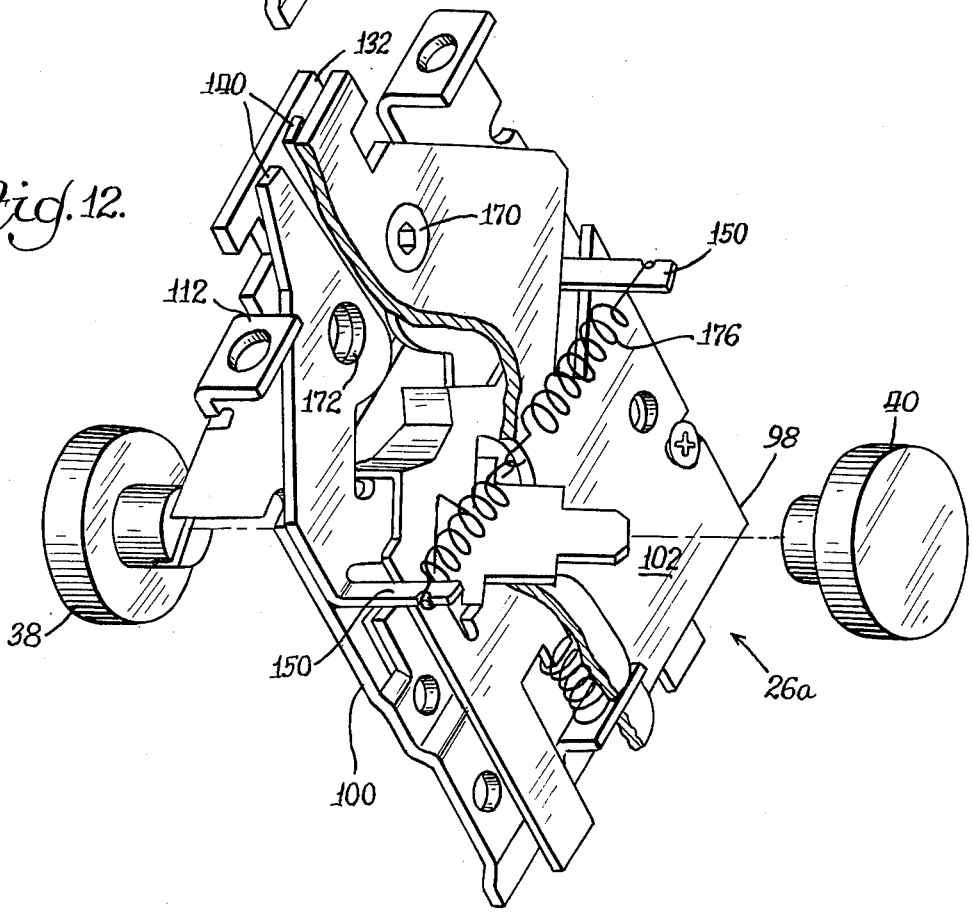
FIG. 12 is similar to FIG. 11, illustrated in open position.

Bolt members 104 and 106 are alike, but not identical. They are the same size and substantial mirror images of each other as best shown in FIG. 10. Each has a flat, plate-like body with a relatively long shank portion 138 and a relatively short latch portion 140 on opposite sides of a pivot screw opening 142. These pivot screw openings are assembled in registration with tapped holes 144 in plate 100. Each bolt member has a diagonal, cam-engaging arm 146 extending off to one side through a common opening 148 in plate 100, and a spring-anchoring arm 150 with a notch 152 extending off the other side, opposite the corresponding arm 146, through a corresponding one of the slots 154 in the other support plate 102.

Figure 13:
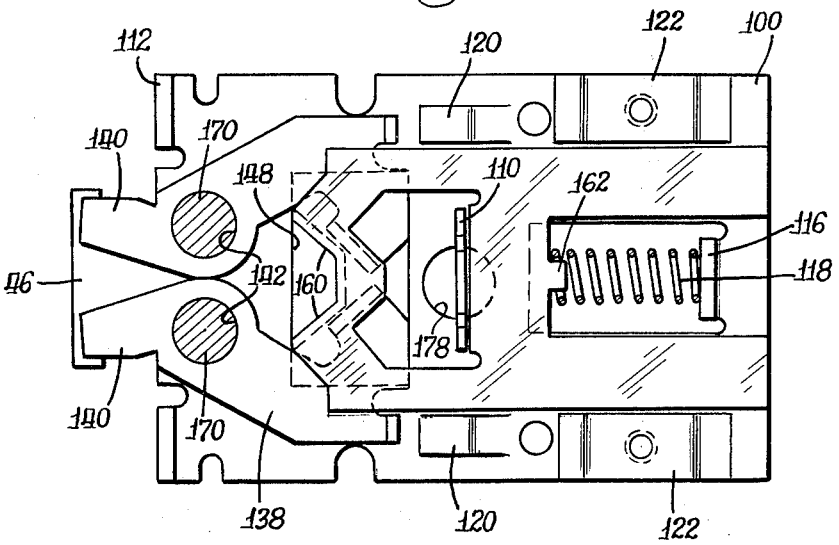
FIG. 13 is an internal view of FIG. 11 showing the mechanism in closed position.
Figure 14:
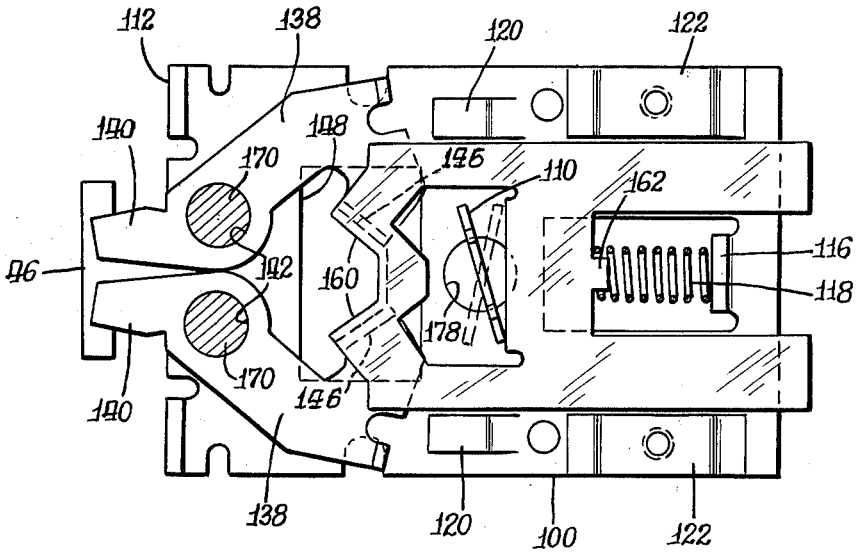
FIG. 14 is similar to FIG. 13, showing the mechanism in open position.

The cam member 108 has a generally rectangular, flat, plate-like body with an opening 156 at one end, an intermediate opening 158, and a pair of diagonal arms 160, 160, flanking the center line, at the opposite end of the cam member. The cam arms 160 extend off to one side, the same direction as arms 146, through the support member opening 148. They overly arms 146, 146 on the respective bolt members, as best shown in FIGS. 13 and 14. As previously described, opposite edges 128, 130 of the cam member 108 are guided between the pairs of inner guide edges 124, 126 on the elements 120, 122 on the support plate 100. The coil spring 118 is compressibly interposed between the tab 116 on support plate 100 and a centering tab 162 on cam edge 164. Clearance for the spring is provided by the openings 156 and 166 in the cam member and support plate respectively, and by the outwardly-arched tunnel section 168 on support plate 102. When assembled, with screws 170, 170 inserted in counterbored holes 172, 172 in support plate 102, through holes 142, 142 in the bolt members, and tightened into tapped holes 144, 144 in support plate 102, the screws function as pivots for the bolt members. Additional spring means, in this case a pair of tension springs 176, 176, hooked together at the center, are connected between the two arms 150, 150. This biases the bolt member latch portions 140, 140 outwardly, toward the closed position shown in FIGS. 11 and 13. Outward movement of the cam member 108, against the spring 118, moves diagonal cam arms 160, 160 against bolt member arms 146, 146, respectively. This spreads the shank portions 138, 138 of the bolt members, scissors fashion, thereby contracts the latch portions 140, 140 toward the open position shown in FIGS. 12 and 14.

The rotary actuator 110 best shown in FIG. 10, is formed from a flat plate. Opposite end portions 182 and 184 fit within slots 186 in the hand knobs 38 and 40 and are journaled for rotation in openings 178 and 180 in support plates 100 and 102 respectively. A section 188, adjacent end portion 184, is journaled within circular opening 178 in support plate 100. A comparable section 190, adjacent end portion 182, is likewise journaled for rotation within opening 180 in support plate 102. Opening 180 is keyhole-shaped to facilitate assembly of actuator 110. A midsection 192 has a pair of opposed ears 194, 194 of suitably small axial dimension to fit freely between the inner support plate surfaces 134 and 136, and engage cam surface 196. As shown in the respective solid and broken lines in FIG. 14, the rotary actuator may be turned in either direction to open the locking mechanism.

The above described arrangments are illustrative of a small number of many possible specific embodiments of the invention. Numerous and varied other arrangements can readily be devised in accordance with the principles disclosed by those skilled in the art without departing from the spirit and scope of the invention.

The embodiments of the invention in which an exclusive property or privilege is claimed are defined as follows:

1. A compact, ambidextrous locking mechanism comprising:

a lock casing adapted to be fastened on an edge of a door and a strike adapted to be fastened to a door jamb opposite said casing;

said casing including a pair of support plates fastened together in spaced relation and having mutually facing inner, parallel surfaces defining a space therebetween;

said plates having identical, spaced, congruent, T-shaped tongues along corresponding edges adapted to extend outwardly beyond the edge of the door into said strike, each of said tongues comprising a central stem and a relatively wider head at the outer end thereof defining a pair of recesses under opposite ends of the head;

a pair of flat, blade-like bolt members having coplanar shank portions located side-by-side in the space between said support plates in slideable, constrained relation with said inner parallel surfaces, and having latch portions located side-by-side between said T-shaped tongues and simultaneously movable between closed and open positions in said recesses, said bolt members being pivotally connected to said support plates intermediate said shank and blade portions;

a flat eccentric, plate-like cam member intermediate said shank portions and coplanar therewith in said space between said support plates in slidable, constrained relation with said inner parallel surfaces, said cam member being movable by shaft means journaled in said support plates, said shaft means being connected to manually operable means; spring means pressing said shank portions against said cam member;

said cam member being movable by said shaft means to move the latch portions selectively between their said closed and open positions; said latch portions being expanded into said recesses in said closed position for engaging said strike, and being contracted within said recesses in said open position for disengaging said strike; and said strike comprising a C-shaped plate having a pocket defined by upper and lower horizontal marginal walls and a back marginal wall, said plate having a passageway opposite said back wall wide enough to enable movement of said central stems of said tongues therethrough into said pocket with the heads of said tongues engaging the undersides of said upper and lower walls, said upper and lower walls having pairs of sawtooth notches for holding said latch portions of the bolt members when in closed positions.

2. A locking mechanism according to claim 1 in which said cam member is a rotatable cam, said manually operable means is directly connected to said cam, and said spring means is connected between the bolt members and the casing.

3. A locking mechanism according to claim 1 in which said cam member is a reciprocable cam supported for reciprocable movement within said space between said pair of support plates, said cam member has a pair of oppositely angularly disposed arms, each engaging a cam follower face on a respective one of said bolt member shank portions whereby movement of said cam member pivots said bolt members simultaneously and moves the latch portions thereof between closed and open positions.

4. A locking mechanism according to claim 3 in which said manually operable means is connected to an actuator which is rotatably journaled in said casing and is engageable with said cam member to provide reciprocable movement thereof in response to rotatable movement of said manually operable means.

5. A locking mechanism according to claim 3 in which a second spring means is provided between the casing and said cam member to urge said cam member in a direction to enable the first mentioned spring means to move the latch of the bolt members to said closed positions.

* * * * *

UNITED STATES PATENT AND TRADEMARK OFFICE

CERTIFICATE OF CORRECTION

PATENT NO. : 4,312,527

DATED : January 26, 1982

INVENTOR(S) : Edward F. Tannery

It is certified that error appears in the above—identified patent and that said Letters Patent is hereby corrected as shown below:

Column 1, line 29, "latch" should be -- hatch --;

Column 2, line 43, "5" should be -- 50 --; and

Column 4, line 53, "overly" should be -- overlie --.

Signed and Sealed thi

*Eighteenth* Day of *May 198*

[SEAL]

*Attest:*

GERALD J. MOSSINGHOFF

*Attesting Officer*

*Commissioner of Patents and Trademarks*